US006010236A

United States Patent [19]

Lai

[11] Patent Number: 6,010,236

[45] Date of Patent: Jan. 4, 2000

[54] CONNECTOR FOR CONNECTING A BULB HOLDER WITH A LAMP SHIELD

[76] Inventor: Wei-Cheng Lai, 9-47, Ho Shin, Ho Shin Tsung, Hu Ko Hsang, Hsinchu Hsien, Taiwan

[21] Appl. No.: 09/056,789

[22] Filed: Apr. 8, 1998

[51] Int. Cl.[7] ..... F21V 21/00

[52] U.S. Cl. ..... 362/396; 362/363; 362/391; 362/806

[58] Field of Search ..... 362/123, 226, 362/249, 252, 391, 363, 396, 806; 439/699.2

[56] References Cited

U.S. PATENT DOCUMENTS 2,703,359 3/1955 Miller ..... 362/396

3,253,137 5/1966 Richter, III ..... 362/806

5,685,635 11/1997 Barhtelmess ..... 362/249

*Primary Examiner*—Y. Quach

*Attorney, Agent, or Firm*—Rosenberg, Klein & Lee

[57] ABSTRACT

This invention relates to a connector, which is cylindrical and is made of plastic, for clipping a bulb holder of a light string and engaging within a lamp shield. A pair of elastic Y-type clippers are provided in the connector which can provide a secure connection with the bulb holder. A pair of connecting belts are also mounted and are able to be connected together to become a ring, that can be hung on a supporter and keeps the bulb holder with the bulb of the light string and the lamp shield firmly placed to display a great decoration.

1 Claim, 4 Drawing Sheets

CONNECTOR FOR CONNECTING A BULB HOLDER WITH A LAMP SHIELD

BACKGROUND OF THE INVENTION

Light strings are used for providing decorative effect. In order to obtain a better display, a plurality of lamp shields are mounted on each light bulb as a cover. The transparent lamp shields are themselves great decorations and can show a soft lighting effect when the bulb insides is lightened. In present time, there is no suitable structure for connecting the bulb with the shield but just forcedly inserted the bulb holder into the shield. It always leads damage and the shield can not be connected with the bulb holder and hung firmly.

OBJECT OF THE INVENTION

The main object of the present invention is to provide a connector which is provided for elastic clipping the bulb holder and is connected with the lamp shield easily. The connector includes a pair of connecting belts, both of which are connected together to be hung on a supporter, and the lamp shield with the bulb will not be accidentally released because of the weight.

The detailed structure, features, and other advantages of this invention will become apparent from the following detailed description of a preferred embodiment when read with reference to the accompanying drawings.

DETAILED DESCRIPTION OF THE EMBODIMENT

Figure 1:
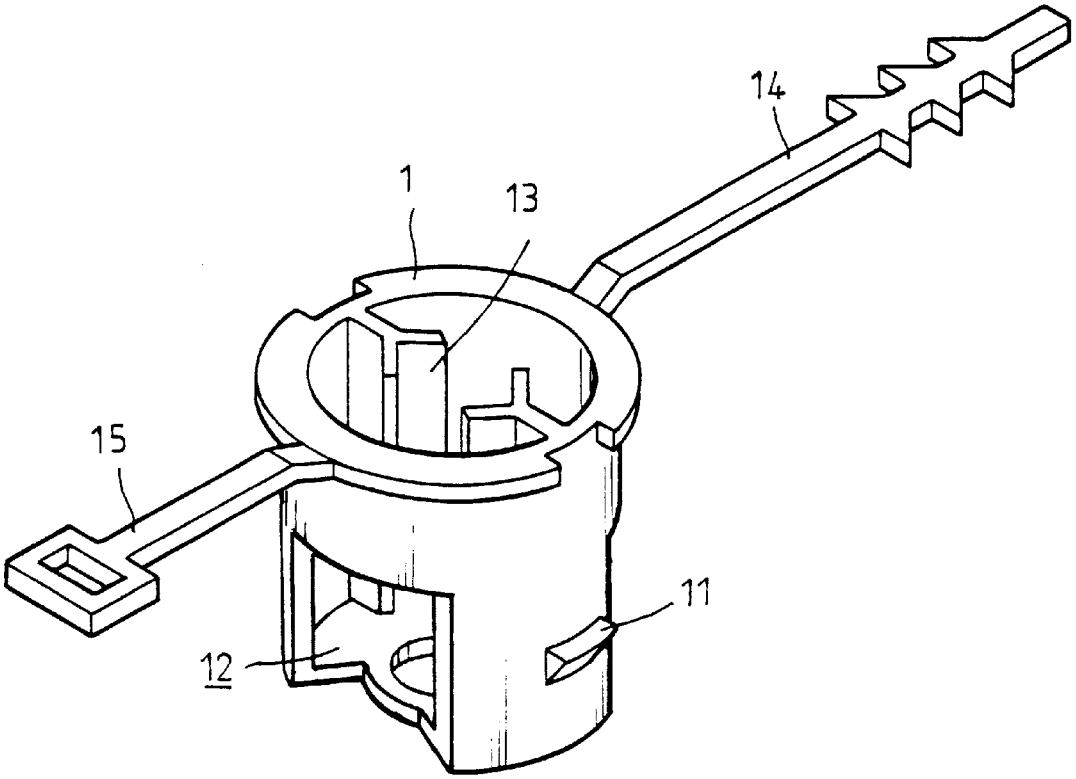
FIG. 1 is a perspective view showing a connector according to the present invention.

Please refer to FIG. 1, the present invention mainly includes a cylindrical connector (1), which includes a pair of flanges (11) on respective two sides and a pair of openings (12) on perpendicular two sides. There are two respective Y-type clippers provided in the connector (1) and a male connecting belt (14) and a female connecting belt (15) formed on top of the connector (1).

Figure 2:
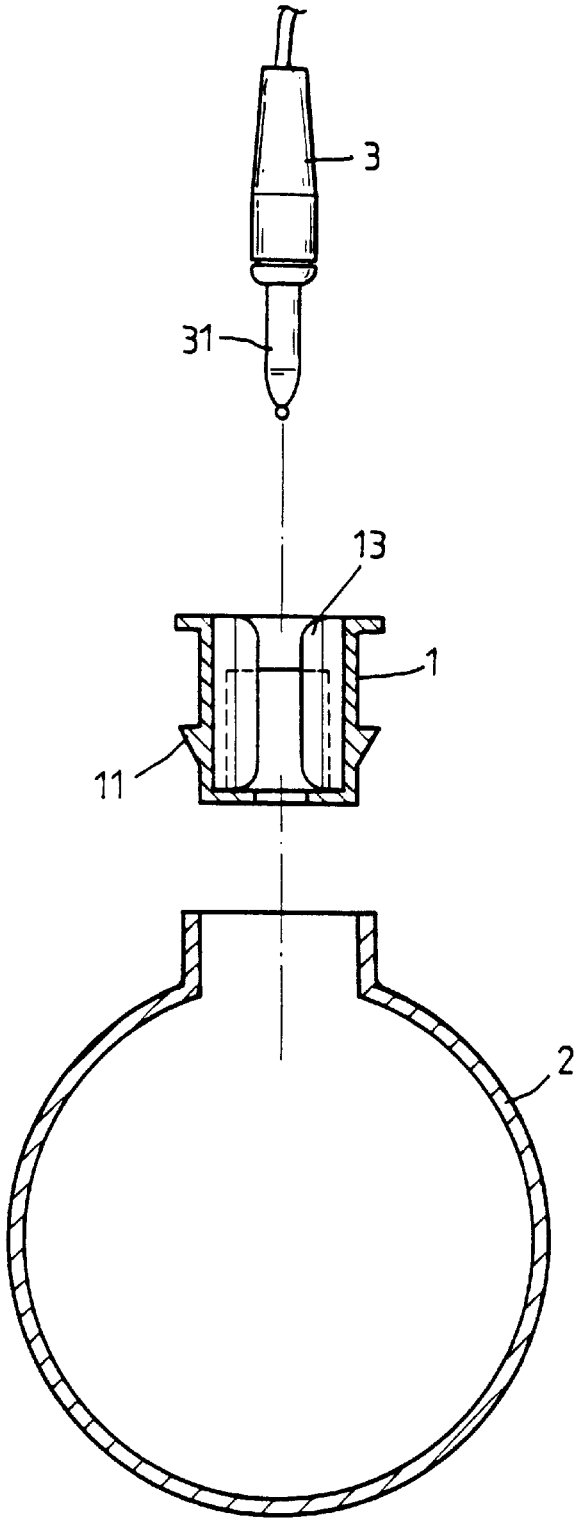
FIG. 2 is a cross sectional view showing the connector, a bulb holder with a bulb, and a lamp shield of the present invention.
Figure 4:
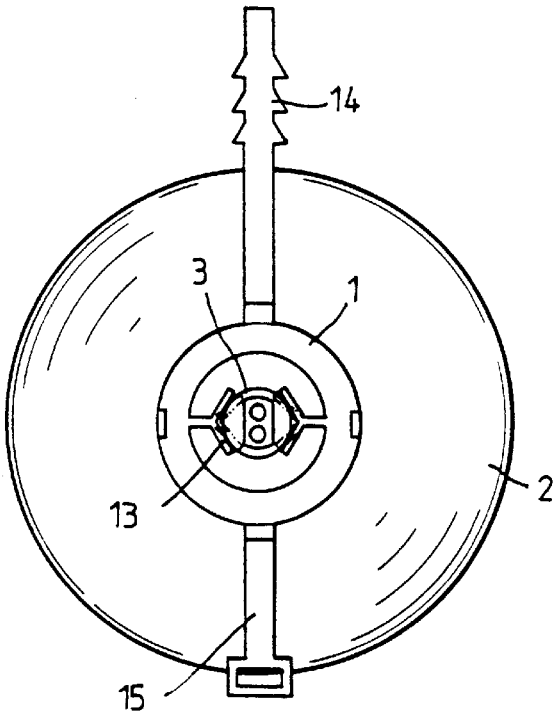
FIG. 4 is a top view of the present invention.
Figure 3:
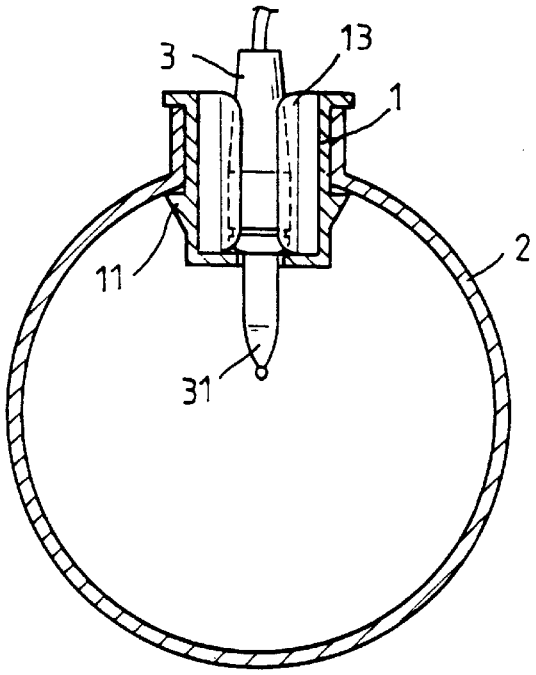
FIG. 3 is an assembled view of FIG. 3.

Referring to FIGS. 2 to 4, the connector (1) is used together with a bulb holder (3) and a lamp shield (2). The diameter of the connector (1) is slightly bigger than the inner diameter of the opening of the lamp shield (2). A space between two Y-type connecting clippers (13) is slightly smaller than the outer diameter of the bulb holder (3). The connector (1) is made of plastic and is capable of being slightly compressed. It is to be known that the bulb holder

(3) can be elastically clipped by the two clippers (13) while the bulb (31) is forward extended. The connector (1) with the bulb holder (3) is then able to be inserted into the opening of the lamp shield (2) and is firmly engaged with the later while the two flanges (11) are hooked in the lamp shield (2). At this moment, the bulb holder (3) is clipped more securely by the two Y-type clippers (13) because of the compression of the lamp shield acting on the connector (1). And the bulb (31) will be positioned in the shield (2).

Figure 5:
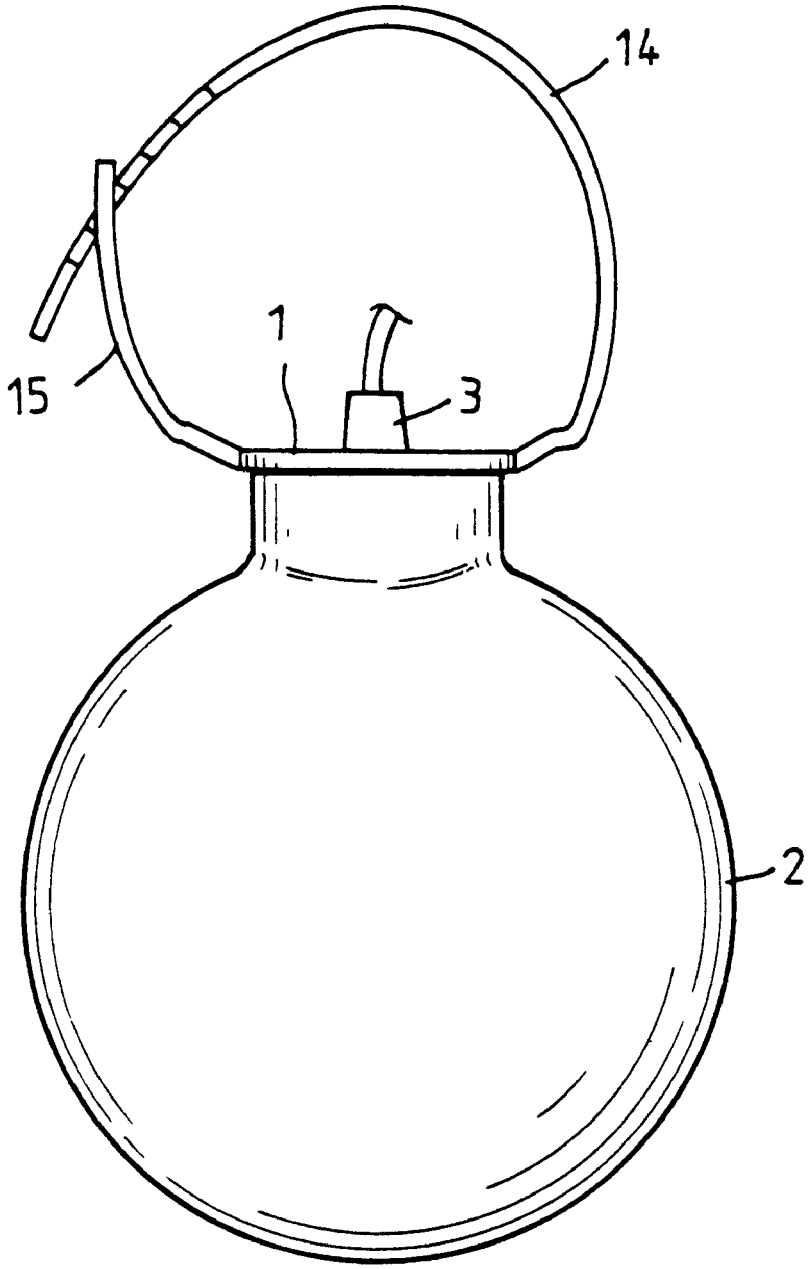
FIG. 5 is a side view of the present invention.

In use, the male connecting belt (14) and the female connecting belt are connected to become a ring for being hung on a supporter, as shown in FIG. 5. So each bulb holder with a bulb of a light string is connected with a connector being engaged with a lamp shield, that provides a great decorative effect. Since the lamp shield and the bulb holder with the bulb are hung on the supporter by the connecting belts on the connector, the connection therebetween is promised and is secure. It will not happen as a prior art that the lamp shield is released from the bulb holder and is broken or damaged.

I claim:

1. A connector for assembling a bulb holder carrying a bulb to a lamp shield, the lamp shield having an opening formed therein for receiving said connector therein, said connector comprising:

(a) a tubular body member having a cylindrical wall with an outer diameter greater than a diameter of the opening in the lamp shield, said cylindrical wall formed of a plastic material and compressible for inserting into the lamp shield opening;

(b) a pair of flanges extending from respective external surfaces of said cylindrical wall on two sides thereof for engagement with respective internal portions of the lamp shield adjacent to the lamp shield opening;

(c) a pair of Y-shaped members extending from respective interior surfaces of said cylindrical wall on opposing sides thereof for receiving the bulb holder therebetween, each said Y-shaped member having a V-shaped portion engaging a respective portion of the bulb holder, a space between said pair of Y-shaped members less than a diameter of the bulb holder, said space further diminished and the Y-shaped member displaced toward each other to tightly engage the bulb holder responsive to insertion of said connector into the lamp shield opening;

(d) a female connecting belt extending longitudinally from one side of said tubular body member; and, (e) a male connecting belt extending longitudinally from an opposing side of said tubular body member for adjustable coupling with said female connecting belt, said male and female connecting belts adjustably coupling together to form a loop, and the assembled bulb holder and lamp shield hanged on an external support through said loop.

* * * * *